US005493500A

United States Patent [19]

Boorsma

[11] Patent Number: 5,493,500

[45] Date of Patent: Feb. 20, 1996

[54] METHOD AND A SYSTEM FOR PREPARING FRANKED POSTAL ITEMS

[75] Inventor: Peter R. Boorsma, Dokkum, Netherlands

[73] Assignee: Hadewe B.V., Drachten, Netherlands

[21] Appl. No.: 212,835

[22] Filed: Mar. 15, 1994

[51] Int. Cl.[6] ..... G07B 17/02

[52] U.S. Cl. ..... 364/464.02; 364/478

[58] Field of Search ..... 364/464.02, 464.03, 364/478

[56] References Cited

U.S. PATENT DOCUMENTS

| | | | |
|---|---|---|---|
| 3,290,491 | 12/1966 | Wahlberg | 364/464.03 |
| 4,516,209 | 5/1985 | Scribner | 364/464.03 |
| 4,797,830 | 1/1989 | Baggarly et al. | 364/464.03 |
| 4,956,782 | 9/1990 | Freeman et al. | 364/464.03 |
| 5,119,306 | 6/1992 | Metelits et al. | 364/464.02 |

*Primary Examiner*—Edward R. Cosimano

*Attorney, Agent, or Firm*—Burns, Doane, Swecker & Mathis

[57] ABSTRACT

A method of and a system for preparing postal items in which, for each item, an assembly is prepared from a plurality of sheetlike parts, the assembly is individually passed to a postage meter and the assembly is franked by the postage meter. A postal value is determined from the weight dependent value of the quantitative property of each assembly and by setting the postage meter for franking each assembly in accordance with the determined postal value. Since the postage meter is thus automatically set for each assembly, the franking with different postal values can be carried out with a single postage meter. Accordingly, only one postage meter needs to be provided downstream of one exit of the packaging station, so only one exit is required and if other exits are available, these can be used for outputting assemblies which need particular attention or treatment.

13 Claims, 1 Drawing Sheet

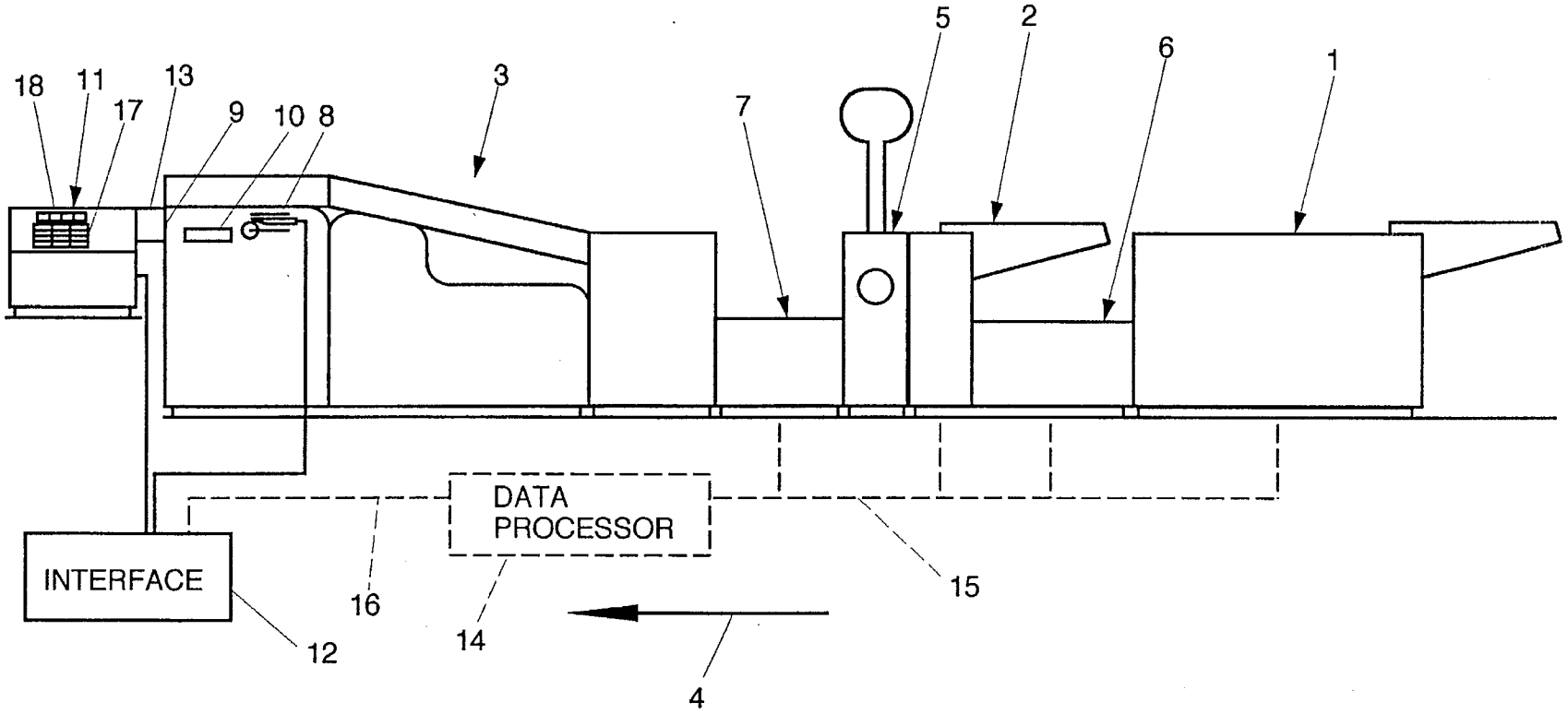
1
6
2
5
7
3
10 8
9
13
17
11
18
15
DATA PROCESSOR
14
16
12
INTERFACE
4

METHOD AND A SYSTEM FOR PREPARING FRANKED POSTAL ITEMS

BACKGROUND OF TEE INVENTION

The invention relates to a method of and a system for preparing franked postal items in which, for each item, an assembly is prepared from a plurality of sheetlike parts, the assembly is individually passed to a postage meter and the assembly is franked by the postage meter.

The sheetlike parts may comprise a prefabricated envelope into which one or more other sheetlike parts are inserted. Alternatively, one of the sheetlike parts may for example have a larger size than the other sheetlike parts and be folded about the other sheetlike parts. Both packaging techniques are as such well known in the art of mail preparation.

From practice it is known to use a configuration comprising an IN-2A inserter station made by HADEWE B. V. in the Netherlands as a packaging station and two postage meters (for example of the type 8500 or 8700 made by Neopost Ltd. in the United Kingdom) each provided downstream of one of two exits of the inserter station and each set to a different postal value.

The inserter station is provided with a switch and with a means for determining a value of a quantitative, weight dependent property of each assembly in form of a thickness detector. The switch is operated in accordance with the detected thickness of each assembly for directing assemblies up to a predetermined thickness to one exit of the inserter station and for directing assemblies of which the detected thickness is larger than the predetermined thickness to the other exit of the inserter station. By setting the postage meters accordingly, it can thus be achieved that assemblies up to a predetermined thickness, and therefore up to a predetermined weight are franked with a first postal value in accordance with the franking class associated with weights below the predetermined weight and that assemblies with a larger thickness are franked with a second, higher postal value in accordance with a franking class associated with weights above the predetermined weight.

A disadvantage of using this configuration is, that two postage meters are needed, which requires additional investment, maintenance and monitoring. Another disadvantage of using this configuration is, that both exits of the inserter station are in use for normal mail, so no additional exit for mail requiring particular attention or treatment is available.

SUMMARY OF THE INVENTION

It is an object of the invention to provide a method and a system in which postal items franked with at least two different postal values can be prepared in a random order while using only one exit of the packaging station and only one postage meter.

According to the present invention, this object is achieved by determining a postal value from the weight dependent value of the quantitative property of each assembly and by setting the postage meter for franking each assembly in accordance with the determined postal value.

Since the postage meter is thus automatically set for each assembly, the franking with different postal values can be carried out with a single postage meter. Accordingly, only one postage meter needs to be provided downstream of one exit of the packaging station, so only one exit is required and if other exits are available, these can be used for outputting assemblies which need particular attention or treatment.

The system for carrying out the method according to the present invention comprises an interface interconnected between the means for determining a value of a weight related quantitative property of each assembly and the postage meter. The interface is arranged for receiving signals representing values of said weight related quantitative property for each assembly from the means for determining a value of a weight related quantitative property for each assembly of sheetlike parts, for determining a postal value from each received value and for sending signals representing each postal value to the postal meter. The postage meter is arranged to be set in accordance with signals received from the interface.

BRIEF DESCRIPTION OF THE DRAWING

The drawing is a schematic side view of a system according to the invention.

DETAILED DESCRIPTION

In the drawing, a system for preparing franked postal items according to the presently most preferred embodiment of the invention is shown. However, dependent on the requirements the intended use brings about, systems with a packaging station in form of a wrapping station instead of in form of an inserter station or with a different configuration upstream of the inserter station may be equally or more preferable.

The shown system comprises three feeding stations for feeding sheetlike parts, in form of a printer 1, an insert feeder 2 and an inserter station 3. In operation, the printer 1 may feed printed documents, the feeder 2 may feed sheetlike inserts of paper or plastic which may for example be in form of single, folded or multilayered sheets or envelopes (generally return envelopes). The inserter station 3 adds sheetlike parts in form of envelopes in which the other sheetlike parts are inserted. The direction of transport of sheetlike parts in the shown system is indicated with arrow 4. Downstream of the insert feeding station 2 a buckle fold station 5 is provided. Between the printer 1 and the insert feeding station 2 and between the buckle fold station 5 and the inserter station 3 transport tracks 6 and 7 are provided, which are each suitable for assembling sheetlike parts fed from upstream stations.

The printer 1 is preferably a laser printer and may for example be provided in form of any commercially available type of laser printer. Insert feeding stations 2, inserter stations 3, buckle fold stations 5 and transport tracks 6 resp. 7 as schematically shown are made by HADEWE B. V. in the Netherlands and marketed as modules of the Neopost System 7 product line.

The inserter station 3 is of the IN-2A type, also made by HADEWE B. V. in the Netherlands and marketed as modules of the Neopost System 7 product line, and is provided with means for determining a value of a weight related quantitative property for each assembly of sheetlike parts in form of a thickness detector 8. The inserter station 3 further comprises a rear exit 9 and a side exit 10.

Downstream of the inserter station 3 a postage meter 11 is provided. In the schematically shown system, the postage meter is a Neopost 8500 postage meter (made by Neopost Ltd., United Kingdom).

An interlace main data processor 12 is interconnected between the thickness detector 8 and the postage meter 11. For the sake of clarity, the interface 12 is shown as a separate device. However, the interface is preferably incorporated in the inserter station 3.

The interface 12 is arranged for receiving signals representing thickness values from the thickness detector, for determining a postal value from each received thickness value and for sending signals representing each postal value to the postal meter 11.

Between the inserter station 3 and the postage meter a transport track 13 is provided for individually transporting assemblies from the inserter station 3 to the postage meter 11 and the postage meter 11 is arranged to be set in accordance with signals received from the interface 12.

In operation, for each item an assembly is prepared from a plurality of sheetlike parts using the System 7 components 2, 3, 5, 6, 7 and the printer 1 in the usual manner. After an assembly has been prepared, a thickness value representing a thickness thereof is determined by the thickness detector 8 and sent to the interface 12. Subsequently, the assembly is individually passed along the transport track 9 to the postage meter 11 and a postal value is determined from the thickness value sent to the interface 12 and signalled to the postage meter 11. The postage meter 11 is set in accordance with the postal value in reaction to the signals received from the interface 12. When the assembly reaches the postage meter 11, it is franked by the postage meter in accordance with the postal value determined by the interface 12 and transmitted to the postage meter 11. The assembly is then a completed postal item ready for mailing.

Since the postage meter 11 is set for franking each assembly in accordance with values of weight dependent properties determined from the respective assembly, assemblies requiring different postal values can be processed in a random order with a single postage meter 11 and using only one exit 9 of the inserter station 3.

Since the value of the quantitative property of the assembly is inputted into the interface 12, the postal value is determined by the interface 12 and outputted from the interface 12 to the postage meter 11, existing systems can simply be adapted for carrying out the method according to the invention by adding the interface 12. It is however also possible to integrate the functions of the interface by suitably programming and connecting a processor of the mail preparation line or of the postage meter 11.

The interface 12 may for example be provided in form of a 80C552 data processor and connected to the same power supply as a data processor included in the inserter station 3. For communication with the postage meter 11 and the thickness detector 8, preferably interfaces according to the RS-485 standard respectively a dedicated interface are provided.

The exit 10 of the inserter station 3 is a divert exit downstream of the transport tracks 6, 7 which also functions for assembling sheetlike parts fed from the feeding stations 1, 2. The connection between the postage meter 11 and the interface 12 is also suitable for inputting postal values into the interface 12 and the interface is arranged for storing the inputted postal value in association with a last inputted thickness value.

The system is arranged for operation in a learning mode in which an assembly is outputted via the divert exit 10 and a postal value inputted into the interface 12 is stored in association with the last inputted thickness value. Thus the interface can simply be programmed for setting the appropriate postal value in reaction to a thickness value obtained from an assembly by detecting the thickness of an assembly of the same thickness, determining the appropriate postal value independent of the system and inputting that postal value into the interface 12. Since, in the learning mode, the assemblies are outputted through the divert exit 10, these are immediately and easily available for the operator who can then determine the appropriate postal value by weighing the assembly using a normal letter-balance and taking into account other factors influencing the postal value, such as urgency class and size of the assembly. Preferably a letter-balance which directly indicates the postal values of the postal item which is being weighed is used. Such a letter-balance may be connected to the postage meter 11 or to the interface 12 for automatically inputting the determined postal value indirectly respectively directly into the interface 12.

The system is further arranged for operation in a production mode in which stored postal values are selected and outputted to the postage meter 11 for franking an assembly if, for that assembly, the thickness value inputted to the interface 12 is within a value range determined from the thickness value stored in association with the selected postal value.

The value range may for example be a tolerance range around the thickness value or a range from zero up to and including a tolerance range around the thickness value. If the weight related property of which the value is determined is characterized by discrete values, the value ranges may be restricted to completely identical values or to ranges from zero up to and including the largest value corresponding with a weight within a postal value class.

A suitable property characterized by discrete values would for example be the number of sheetlike parts of an assembly. This number can be determined without detection from assemblies by converting control instructions for the feeder stations 1, 2 relating to an assembly into a signal representing the number of sheetlike parts of that assembly and by sending this signal to the interface 12.

A system for determining the number of supplied sheetlike parts of each assembly is preferably provided with a second data processor 14 for determining the number of sheetlike parts of each assembly and a connection between the interface and the data processor for sending signals representing the number of sheetlike parts of each assembly from the data processor to the interface. The data processor 14 and the connections 15, 16 of this variant are displayed by dotted lines.

Each time postal items are to be prepared of which the thicknesses relate differently to existing postal value classes or postal value classes are changed, operation in the learning mode precedes operation in the production mode to store new thickness/postal value relations. Operation may also switch from the production mode to the learning mode if a thickness value outside value ranges for which postal values have been determined is received by the interface. Preferably, the operator is then urged by a signal to determine and input the postal value for that new thickness value.

The postage meter 11 is provided with means in form of a keyboard 17 and a display 18 for manually setting a postal value. The connection of the postage meter 11 to the interface 12 is adapted for sending a signal representing its postal value setting to the interface 12. After, in the learning mode, the postal value for the assembly outputted via the divert exit 10 has been determined, the postage meter 11 is manually set by the operator to the postage value determined by that operator and a signal representing the postal value as set is transmitted from the postage meter 11 to the interface 2.

This brings abut the advantage that no separate means for inputting the postal value other than the normal means generally provided on conventional postage meters are required and that the operator can set the required postal value in the same manner as the postal value of a conventional stand-alone postage meter is set.

Preferably, the diverted assembly is manually supplied to the postage meter 11 and franked in accordance with the determined postal value after the postage meter has been set. Thus the operation in the learning mode is completely identical to the operation when a conventional stand-alone postage meter is used, but in reaction to the franking of the assembly diverted via divert exit 10, the applied postal value is inputted into the interface in association with a value range determined by the thickness value previously determined by the thickness detector 8. Another advantage of inputting the determined postal value to the interface 12 in reaction to the action of franking the diverted assembly is that the diverted assembly is immediately franked and requires no separate further attention.

In the shown system, postal values are only communicated from the interface 12 to the postage meter 11 if an assembly requires a different postal value than a previous assembly. If an assembly is to be franked with the same postal value as a previous assembly, no postal value signal is transmitted to the postage meter. If no postal value signal is received from the interface 12, the postage meter 11 reacts by maintaining its current postal value setting and by franking each assembly it receives with that postal value.

If a postal value determined for an assembly is different from the postal value for another previous assembly, the assembly requiring the different postal value is maintained upstream of the postage meter 11 at least until the preceding assembly has been franked to allow the postage meter sufficient time for changing to another postal value. Before the assembly which is maintained upstream of the postage meter 11 is passed to the postage meter 11, furthermore the number of assemblies franked by the postage meter 11 is compared with the number of postal values determined by the interface 12. Only if the number of assemblies franked by the postage meter 11 is found to be in accordance with the number of determined postal values, the interruption of the supply of assemblies to the postage meter 11 is terminated. Otherwise an alarm signal is generated so the operator can remove the cause of the malfunction and take measures to correct the effect of the malfunction, before operation of the system is allowed to restart or continue.

Thus the interruption which is required for changing the postage meter 11 from one postal value setting to another postal value setting is used to crank all assemblies which are still in process and downstream of the assembly requiring the different postal value. This in turn brings about that the section of the system downstream of the assembly requiring the different postal value is emptied and that differences between the number of determined postal values and the number of franking actions indicate that either assemblies were added or went missing in the section of the system downstream of the assembly requiring the different postal value, or that either assemblies passed the postage meter without being franked or may have been franked twice. Each time the setting of the postage meter 11 is changed, the operation of the section of the system downstream of the location where each assembly requiring a different postal value than the previous assembly is maintained is thus monitored in a simple manner. Preferably, this location is in the inserter station 3.

Of course, from the present disclosure many other embodiments than the above described examples will be apparent to the skilled person. Instead of using a thickness value or a value indicating the number of sheetlike parts of an assembly, it is for example also possible to determine and store the thickness of each individual type of sheetlike parts and determine the thickness of an assembly from the composition of that assembly. Another property related to the weight of an assembly, and in some countries directly related to the required postal value, is the size of the assembly. This size may also be determined and taken into account upon determination of the required postal value by the interface 12.

What is claimed is:

1. A method of preparing franked postal items comprising, for each item, the steps of:

preparing an assembly from a plurality of sheetlike parts, determining a value of a quantitative property other than weight of the prepared assembly, determining a postal value directly from said value of said quantitative property, setting a postage meter in accordance with said postal value, transporting the assembly individually to the postage meter, and franking the assembly with the postage meter.

2. A method according to claim 1, wherein said value of said quantitative property of the assembly is inputted into an interface, the postal value is determined by said interface and outputted from said interface to the postage meter.

3. A method according to claim 1, in which the property of which the value for each assembly is determined is the number of sheetlike parts of each assembly.

4. A method of preparing franked postal items comprising, for each item, the steps of:

preparing an assembly from a plurality of sheetlike parts, determining a value of a quantitative property other than weight of the assembly, determining a postal value directly from said value of said quantitative property, setting a postage meter in accordance with said postal value, transporting the assembly individually to the postage meter, and franking the assembly with the postage meter, wherein the method further comprises a learning mode which precedes operation in a production mode, the learning mode comprising the steps of determining a value of a quantitative property other than weight for an assembly, outputting said assembly to an operator, weighing the assembly, determining the postal value for said assembly dependent on at least its weight, inputting the determined postal value for said assembly into the interface and storing the postal value in association with said inputted value of said quantitative property of said assembly, and wherein the production mode comprises the steps of retrieving said postal value based on the measured value of the quantitative property and outputting the postal value to the postage meter for franking an assembly if, for that assembly, the value of said quantitative property is identical to or within a value range determined from the value stored in association with said postal value.

5. A method according to claim 4, wherein, after the postal value for the outputted assembly has been determined, the postage meter is manually set to said postage value and said manually set postal value is outputted from the postage meter to the interface.

6. A method according to claim 5, wherein, after the postage meter has been set to the determined postal value, said outputted assembly is supplied to the postage meter and franked in accordance with said postal value setting.

7. A method of preparing flanked postal items comprising, for each item, the steps of:

preparing an assembly from a plurality of sheetlike parts, determining a value of a quantitative property other than weight of the assembly, determining a postal value directly from said value of said quantitative property, setting a postage meter in accordance with said postal value, passing the assembly individually to the postage meter, and franking the assembly with the postage meter, wherein if a postal value determined for an assembly is different from the postal value for an assembly preceding said assembly, said assembly is maintained upstream of the postage meter at least until said preceding assembly has been flanked, the number of flanked assemblies has been compared with the number of determined postal values and determined to be in accordance with the number of determined postal values.

8. A method of preparing flanked postal items comprising, for each item, the steps of:

preparing an assembly from a plurality of sheetlike parts, determining a value of a quantitative property other than weight of the assembly, determining a postal value directly from said value of said quantitative property, setting a postage meter in accordance with said postal value, passing the assembly individually to the postage meter, and flanking the assembly with the postage meter, wherein the quantitative property from which the value for each assembly is determined is the thickness of each assembly.

9. A system for preparing flanked postal items comprising:

at least one feeding station for feeding sheetlike parts, means for assembling the sheetlike parts fed from the at least one feeding station into an assembly, means for determining a value of a quantitative property other than weight for each assembly of sheetlike parts, a packaging station, a postage meter for franking the assembly, a main data processor interconnected between the means for determining a value of a quantitative property of each assembly and the postage meter, said data processor being connected to receive signals representing values of said quantitative property for each assembly from the means for determining a value of a quantitative property for each assembly of sheetlike parts, and including means for directly determining a postal value from each received value and means for sending signals representing each postal value to the postal meter, and a transport track between the packaging station and the postage meter, said transport track being arranged for individually transporting assemblies from the packaging station to the postage meter, said postage meter being arranged to be set in accordance with signals received from the data processor.

10. A system according to claim 9, wherein the means for determining a value of a quantitative property other than weight for each assembly of sheetlike parts is a second data processor for determining, for each assembly, the number of fed sheetlike parts and a connection between the second data processor and the main data processor for sending signals representing said numbers from the second data processor to the main data processor.

11. A system for preparing flanked postal items comprising:

at least one feeding station for feeding sheetlike parts, means for assembling the sheetlike parts fed from the at least one feeding station into an assembly, means for determining a value of a quantitative property other than weight for each assembly of sheetlike parts, a packaging station, a postage meter for franking the inserted assembly, a main data processor interconnected between the means for determining a value of a quantitative property of each assembly and the postage meter, said data processor being connected to receive signals representing values of said quantitative property for each assembly from the means for determining a value of a quantitative property for each assembly of sheetlike parts, and including means for directly determining a postal value from each received value and means for sending signals representing each postal value to the postal meter, and a transport track between the packaging station and the postage meter, said transport track being arranged for individually transporting assemblies from the packaging station to the postage meter, said postage meter being arranged to be set in accordance with signals received from the data processor, and means for inputting postal values into the data processor and for storing the inputted value in association with a last inputted value of a quantitative property, wherein the system is arranged for operation in a learning mode in which an assembly is outputted and a postal value inputted into the data processor is stored in association with the last inputted value of a quantitative property, and for operation in a production mode in which said postal value is selected and outputted to the postage meter for flanking an assembly if, for that assembly, the inputted value of said quantitative property is identical to or within a value range according to the value stored in association with said postal value.

12. A system for preparing franked postal items comprising:

at least one feeding station for feeding sheetlike parts, means for assembling the sheetlike parts fed from the at least one feeding station into an assembly, means for determining a value of a quantitative property other than weight for each assembly of sheetlike parts, a packaging station, a postage meter for flanking the inserted assembly, a main data processor interconnected between the means for determining a value of a quantitative property of each assembly and the postage meter, said data processor being connected to receive signals representing values of said quantitative property for each assembly from the means for determining a value of a quantitative property for each assembly of sheetlike parts, and including means for directly determining a postal value from each received value and means for sending signals representing each postal value to the postal meter, and a transport track between the packaging station and the postage meter, said transport track being arranged for individually transporting assemblies from the packaging station to the postage meter, said postage meter being arranged to be set in accordance with signals received from the data processor and the postage meter including means for manually setting a postal value and being connected to the data processor for sending a signal representing the postal value setting to the data processor.

13. A system for preparing franked postal items comprising:

at least one feeding station for feeding sheetlike parts, means for assembling the sheetlike parts fed from the at least one feeding station into an assembly, means for determining a value of a quantitative property other than weight for each assembly of sheetlike parts, a packaging station, a postage meter for franking the inserted assembly, a main data processor interconnected between the means for determining a value of a quantitative property of each assembly and the postage meter, said data processor being connected to receive signals representing values of said quantitative property for each assembly from the means for determining a value of a quantitative property for each assembly of sheetlike parts, and including means for directly determining a postal value from each received value and means for sending signals representing each postal value to the postal meter, and a transport track between the packaging station and the postage meter, said transport track being arranged for individually transporting assemblies from the packaging station to the postage meter, said postage meter being arranged to be set in accordance with signals received from the data processor, wherein the means for determining a value of a quantitative property for each assembly of sheetlike parts is a thickness detector.

* * * * *